US008925166B2

(12) United States Patent
Erni

(10) Patent No.: US 8,925,166 B2
(45) Date of Patent: Jan. 6, 2015

(54) RIVET-FITTING TOOL

(75) Inventor: Alain Erni, Bichwil (CH)

(73) Assignee: Würth International AG, Chur (CH)

( * ) Notice: Subject to any disclaimer, the term of this patent is extended or adjusted under 35 U.S.C. 154(b) by 0 days.

(21) Appl. No.: 13/818,139

(22) PCT Filed: Aug. 23, 2011

(86) PCT No.: PCT/EP2011/064453

§ 371 (c)(1),
(2), (4) Date: Mar. 13, 2013

(87) PCT Pub. No.: WO2012/025519

PCT Pub. Date: Mar. 1, 2012

(65) Prior Publication Data

US 2013/0205556 A1 Aug. 15, 2013

(30) Foreign Application Priority Data

Aug. 24, 2010 (DE) ..... 10 2010 039 670

(51) Int. Cl.

| | |
|---|---|
| ***B21J 15/22*** | (2006.01) |
| ***B21J 15/32*** | (2006.01) |
| ***B21J 15/10*** | (2006.01) |
| ***B21J 15/04*** | (2006.01) |

(52) U.S. Cl.

CPC ..... *B21J 15/105* (2013.01); *B21J 15/326* (2013.01); *B21J 15/043* (2013.01)

USPC ..... 29/243.521; 29/243.523; 29/243.526

(58) Field of Classification Search

CPC ..... B21J 15/105; B21J 15/22; B21J 15/326; B21J 15/043; B21J 15/022

USPC ..... 29/243.521, 243.522, 243.523, 29/243.524, 243.525

See application file for complete search history.

(56) References Cited

U.S. PATENT DOCUMENTS

| | | | | |
|---|---|---|---|---|
| 3,082,898 | A | 3/1963 | Bosch | |
| 5,473,805 | A * | 12/1995 | Wille | 29/243.526 |
| 5,778,516 | A | 7/1998 | Dear et al. | |
| 6,163,945 | A * | 12/2000 | Amano et al. | 29/243.523 |
| 6,276,037 | B1 * | 8/2001 | Solfronk | 29/243.525 |
| 6,883,216 | B2 | 4/2005 | Gilbert et al. | |

FOREIGN PATENT DOCUMENTS

| | | | |
|---|---|---|---|
| CN | 201431990 | Y | 3/2010 |
| DE | 3851521 | T2 | 2/1995 |
| EP | 0130040 | A2 | 1/1985 |
| JP | 6328182 | A | 11/1994 |
| SU | 1299698 | A1 | 3/1987 |

* cited by examiner

*Primary Examiner* — David B Jones
(74) *Attorney, Agent, or Firm* — Boyle Fredrickson, S.C.

(57) ABSTRACT

A rivet setting device contains in a housing a receiving chamber in which a break-off rivet mandrel is situated after the setting operation. Arranged in this receiving chamber are two elongate magnets which leave free between them a space for the residual mandrel and which attract the residual mandrel from the holder for the rivet after it has been broken off and retain it. The holder for the residual mandrel can be moved with a transverse component in the device, with the residual mandrel being moved past a stripping element into a region outside the axis of the holder for the rivet. During the rearward movement of the residual mandrel holder, the residual mandrel is stripped off and remains in a collecting chamber.

9 Claims, 2 Drawing Sheets

RIVET-FITTING TOOL

The invention relates to a rivet setting device.

With the aid of rivet setting devices, blind rivets for connecting at least two objects are set from the front side on an object and also deformed from the front side such that a closing head is formed on the rear side of the object on which the fastening takes place. For this purpose, using a rivet mandrel which acts on the rivet body on the opposite rear side, pulling takes place from the front side. For pulling on the rivet mandrel, there are manually actuated tongs or rivet setting devices having a motor drive. When setting the blind rivet, the rivet mandrel breaks off at a predetermined breaking point. The predetermined breaking point is usually formed in the rivet mandrel at a point which is arranged as far as possible still in the rivet sleeve. The broken-off remainder of the rivet mandrel must be disposed of.

There is already known a blind rivet setting device in which an electric motor actuates a pulling device which pulls on the rivet mandrel of the blind rivet held in the device. For pulling engagement on the rivet mandrel, a clamping tong is provided which has an inner cone and consequently loads clamping jaws inwardly against the rivet mandrel. As soon as the rivet mandrel has broken off, the user can tilt the device upwardly, with the result that the broken-off rivet mandrel slides downward through a tube and into a container (DE 4126602).

The object on which the invention is based is to provide a rivet setting device which collects the broken-off rivet mandrel remains without additional intervention or an additional measure on the part of the user.

To achieve this object, the invention proposes a rivet setting device having the features stated in claim 1. Further embodiments of the invention form the subject matter of subclaims.

The rivet setting device thus contains a housing and, in the housing, a holder for a rivet to be set. The holder conventionally engages on the rivet mandrel arranged in the rivet. A pulling device is arranged in the device and preferably engages with clamping jaws and clamping tongs on the rivet mandrel and pulls it in the axial direction. In the extension of the rivet mandrel, a receiving chamber is formed in the housing, said chamber being large enough for a rivet mandrel which is broken off during the formation of the closing head to be able to be received in said chamber. The broken-off part of the rivet mandrel is referred to hereinbelow as the residual mandrel. According to the invention, the receiving chamber is then assigned at least one magnet which attracts the severed residual mandrel and retains it therein.

For example, the magnet can be arranged at a distance, corresponding to the length of the residual mandrel, from the end of the holder in the axial extension of the holder. In this way, it can retain the residual mandrel there without impeding the exiting of the residual mandrel from the holder.

A further possibility of how the magnet can be arranged comprises arranging it, as seen in end view, laterally with respect to the space in the receiving chamber provided for the severed residual mandrel. In this way, it can be arranged directly behind the end of the holder and cooperate during the movement of the residual mandrel out of the holder.

It is particularly expedient, as the invention proposes in a further embodiment, to arrange two such magnets, specifically in each case one such magnet on opposite sides of the space in the receiving chamber provided for the severed residual mandrel. The two magnets here are preferably arranged in such a way that they leave free a space between them which is only slightly larger than the diameter of the residual mandrel.

It can be provided in particular to make at least one of the two, preferably both, magnets at least 50% of the length, preferably at least 75% of the length and, more preferably, at least exactly the length of the residual mandrel.

For the correct positioning of the residual mandrel in the receiving chamber, it can be provided according to the invention that a stop is formed or arranged at the end of the receiving chamber, against which stop the residual mandrel comes to bear or butts.

Since the receiving chamber and, if appropriate, the arrangement of the two magnets are preferably designed in such a way that only a single residual mandrel can be received there, the invention proposes in a further embodiment to accommodate in the housing a device for transporting away the residual mandrel contained in the receiving chamber into a collecting chamber likewise present in the housing.

For this purpose, it can be provided that the at least one magnet, but preferably both magnets are accommodated in a magnetic holder which is arranged so as to be movable in a direction transversely with respect to the longitudinal direction.

This holder can thus be in a position in which the two magnets are arranged in the described manner behind the end of the holder for the rivet mandrel. From this receiving position the magnetic holder can be displaced laterally to such an extent that space is present for the rivet behind the end of the holder, through which space a drive can act on the next rivet to be set which is now arranged in the holder. This position in which the rivet to be set is released for access by the setting device forms a release position of the magnetic holder.

According to the invention, at least one stripping element can be arranged in the housing, said element being situated in the path of the residual mandrel when the latter is moved together with the magnetic holder from the receiving position into the release position.

The stripping element is intended to be designed in such a way that, during the rearward movement of the magnetic holder from the release position into the receiving position, it strips the residual mandrel such that the latter is disengaged from the at least one magnet and then falls into the collecting chamber and remains therein. Since the residual mandrel is an elongate object, two such stripping elements are preferably arranged in the device, said elements each acting on the residual mandrel in the end region thereof.

According to the invention, in order to move the magnetic holder from the receiving position, in which thus the residual mandrel is engaged with the magnet, into the release position, a dedicated actuating element, whether mechanical or motor-operated, can be provided. Of course, synchronization or blocking must be provided so that a setting operation can take place only with the magnetic holder in the release position.

However, it is also possible that the movement of the magnetic holder takes place by means of a drive which is common with the remaining actuations of the rivet setting device. The rivet mandrel breaks off during the operation of the pulling device. At this time, the magnetic holder must thus be in the receiving position. After the actuation of the pulling device and after the rivet mandrel has been broken off, the pulling device must return again to its initial position. The setting operation is then triggered. The triggering of the setting operation can be used to move the magnetic holder from the receiving position into the release position.

It has already been mentioned that the rivet setting device has a collecting chamber for a plurality of residual mandrels. According to the invention, it can be provided that the collecting chamber is arranged at a point on the rivet setting device which is situated at the bottom during normal horizontal handling of the rivet setting device.

In a further embodiment of the invention, it can be provided that a non-rectilinearly extending channel is provided for the movement path of the residual mandrels in order to prevent residual mandrels from passing back into the receiving chamber during non-horizontal handling of the device and causing a blockage in the channel.

Further features, details and advantages of the invention will become apparent from the claims and the abstract, the wording of both being incorporated in the description by reference, and from the description below of preferred embodiments of the invention and with reference to the drawing, in which:

Figure 1:
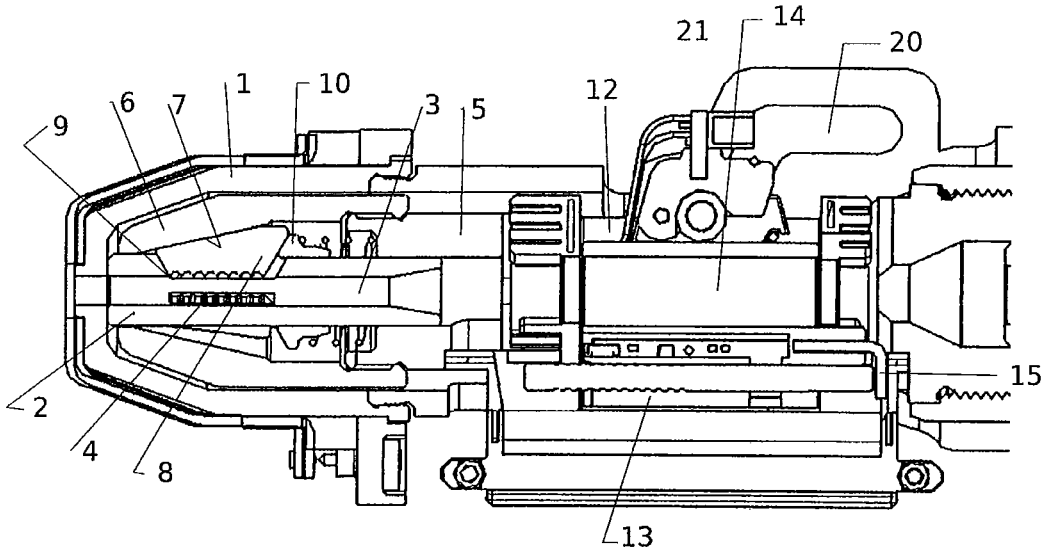
FIG. 1 shows a longitudinal section through a front end of a rivet setting device according to the invention, in which the holder is in the release position.
Figure 2:
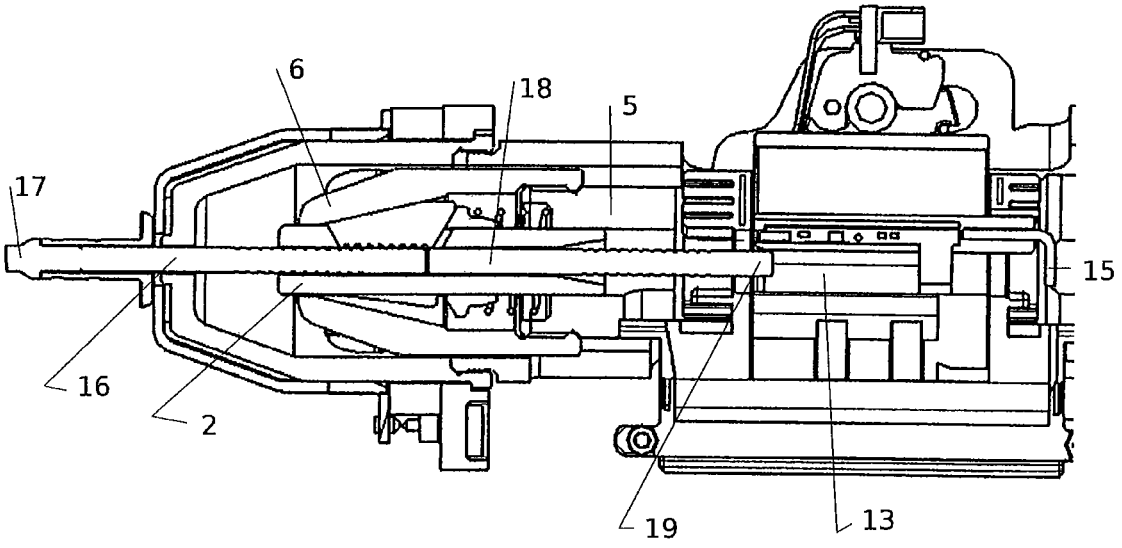
FIG. 2 shows the section of FIG. 1 in another position, with the holder being in the receiving position.
Figure 3:
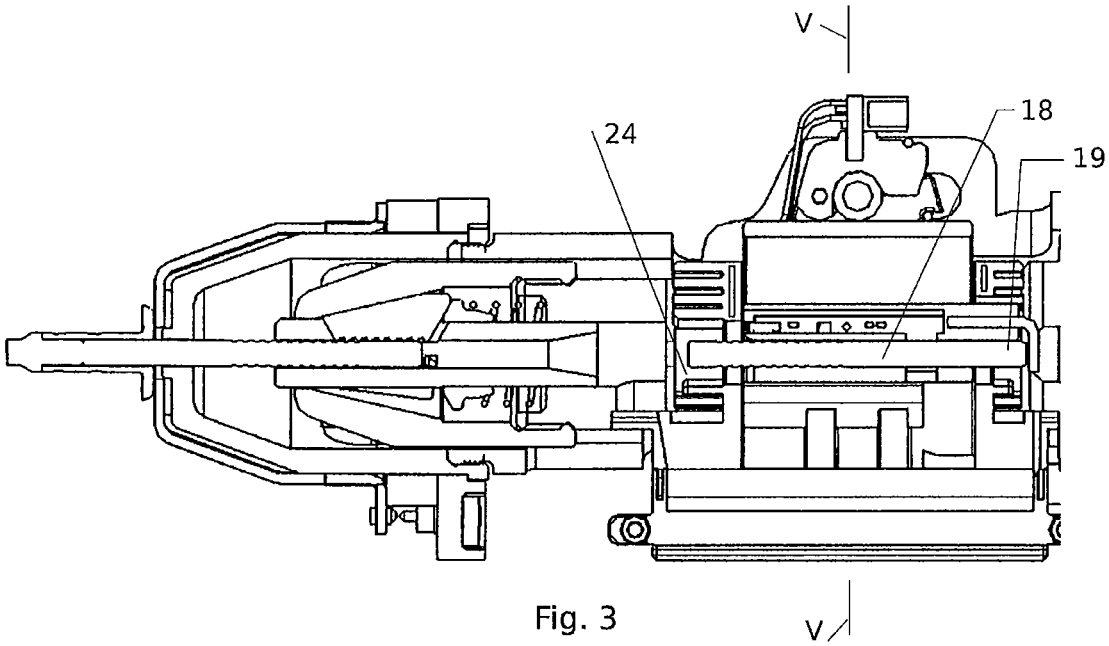
FIG. 3 shows a further section through the rivet setting device in yet another stage of the actuation.

The front end, illustrated in FIG. 1 to FIG. 3 in a longitudinal section, of a rivet setting device according to the invention contains a housing 1. Accommodated in the housing 1 is a holder 2 for a blind rivet to be set using the device. The holder 2 forms a channel 3 in a tubular component. The rivet mandrel, which forms part of the blind rivet, is intended to be inserted in the channel 3. The rivet is thus held in the device by means of the rivet mandrel. The holder 2 formed as a tube contains three slots 4 distributed over the circumference.

A pulling device 5 cooperates with the holder 2. The pulling device, which can be moved by a drive (not shown) from the position represented in FIG. 1 to the right in FIG. 1, contains clamping tongs 6 with an inner cone surface 7. In the illustrated example, three clamping jaws 8 bear against this inner cone surface 7, which jaws can engage into the channel 3 with their radially inwardly directed inner sides 9 through the already-mentioned slots 4 and can grip the rivet mandrel. A movement of the pulling device 5 to the right displaces the clamping jaws 8 radially inwardly, and during the displacement of the pulling device 5 back to the left again, a jaw closer 10, under the action of a compression spring, pushes the clamping jaws 8 axially forward again and thus radially outwardly.

In the axial extension of the holder 2 or of the channel 3 formed therein, a residual mandrel holder 12 is arranged in the housing. The residual mandrel holder 12 has two magnets 13, of which the section of FIG. 1 shows only one such magnet 13. The other magnet is arranged in front of the section plane. The magnet 13 extends in an elongate manner and, owing to the residual mandrel holder 12, is arranged at this point, that is to say behind the end of the holder 2.

The residual mandrel holder 12 has in its upper region a through-passage 14 which, in the position of the residual mandrel holder 12 illustrated in FIG. 1, is arranged in the axial extension of the holder 2. In this position, a plunger (not shown) for driving in a rivet can be pushed forward through the through-passage 14 into engagement with a rivet mandrel arranged in the channel 3. The residual mandrel holder 12 is situated in FIG. 1 in the release position, in which it thus releases the holder 2 for the engagement with a plunger in order to drive in the rivet.

At the end of the residual mandrel holder 12 that faces away from the holder 2, a stop 15 is formed in the region of the end of the magnet 13, the distance of which stop from the end of the holder 2 is somewhat larger than the length of the residual mandrel. By residual mandrel is meant the part of a rivet mandrel which is situated beyond the predetermined breaking point. This part of the rivet mandrel is broken off during the setting operation.

In the position illustrated in FIG. 1, as seen from the left, a rivet mandrel seated in a rivet is inserted into the channel 3 until the blind rivet bears against the front side of the housing 1. Then, the rivet is driven in using the plunger mentioned. After the rivet is set, the residual mandrel still remains in the channel 3. If the next rivet is now inserted, we arrive at the illustration of FIG. 2. Here, with the pulling device 5 in the actuated state, a rivet mandrel 16 of the next blind rivet 17 to be set is inserted in the channel 3. During insertion of the rivet mandrel 16, the latter pushes the residual mandrel 18 still present from the last setting operation somewhat out of the channel 3 of the holder 2 toward the rear. At this time, the residual mandrel holder 12 is in its receiving position, in which the magnet 13 is thus arranged behind the channel 3. As soon as the residual mandrel 18 has passed somewhat out of the rear end of the holder 2, see FIG. 2, it is influenced by the two magnets 13 which now pull it out of the holder 2 and pull it completely into the space between the two magnets 13. It is thus moved so far until it bears with its front end 19 against the stop 15. This situation is illustrated in FIG. 3.

The pulling device 5 can now be released, the clamping tongs 6 are moved back into the position illustrated in FIG. 1, and the jaw closer 10 pushes the clamping jaws 8 outwardly again. It is now possible for a new setting operation to begin. For this purpose, it is then required again for the residual mandrel holder 12 to be moved back as far as the position illustrated in FIG. 1.

As can be gathered from a comparison of FIGS. 1 and 2, the residual mandrel holder 12 is situated not only in two positions which are different in a direction transversely with respect to the longitudinal axis, but also in two positions which are different in the axial direction. When displacing the residual mandrel holder from the position of FIG. 2, that is to say the receiving position, into the release position of FIG. 1, an axial displacement and a transverse displacement occur. This can be seen from the shape of the slot 20 (slotted guide). A pin 21 which projects on both sides from the residual mandrel holder 12 engages in the slot 20. The residual mandrel holder 12 is connected to the pulling device 5 in the axial direction.

Figure 4:
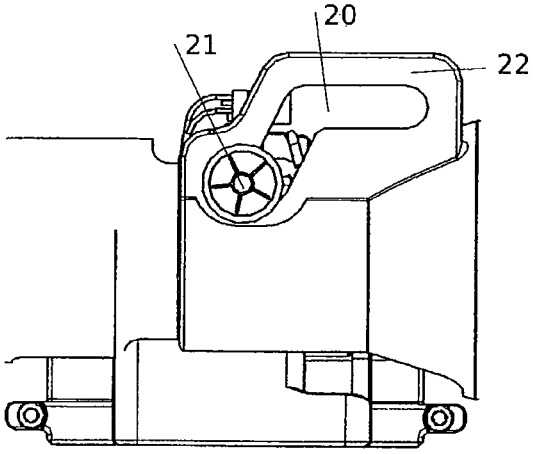
FIG. 4 shows a partial side view of a part of the rivet setting device.

This can be gathered more exactly from FIG. 4. Here, the component 22 of the housing 1 that has the slot 20 is illustrated in a side view. The slot 20 extends in the longitudinal direction and then bends off obliquely downward. In the illustration of FIG. 4, the pin 21 has arrived at the lower end of the slot 20.

Figure 5:
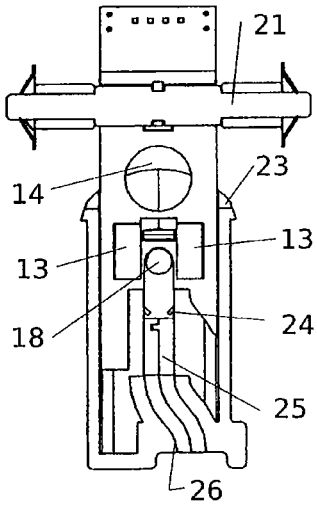
FIG. 5 shows a cross section through the rivet setting device along line V-V in FIG. 3.

FIG. 5 shows a cross section through the guide of the residual mandrel holder 12 approximately along line V-V in FIG. 3. Here, too, can be seen the transversely extending pin 21 which engages on both sides into the slot 20. The residual mandrel holder 12 has the through-passage 14 in its upper region. Said holder is guided in a component 23 which is not concomitantly displaced downward during the displacement. The two magnets 13 enclose between them the residual mandrel 18 which can be seen in cross section. Somewhat below the location of the residual mandrel 18 can be seen the two ends of one of the two stripping elements 24. These are oriented to one another in such a way that the residual mandrel 18 can be pressed from top to bottom through them but such that the reverse movement is prevented by the stripping element 24.

Below the stripping element 24 there is formed a channel 25 in the component 23, which remains stationary during the displacement, which channel has a curvature 26 before it ends at the lower side of the component 23. The collecting chamber for a plurality of residual mandrels 18 is arranged on the lower side of the component 23.

Figure 6:
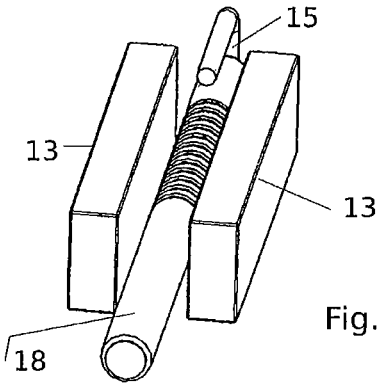
FIG. 6 shows in perspective the arrangement of a residual mandrel between two magnets.

FIG. 6 again shows, for explanation, how the two magnets 13 are arranged. These magnets are two equally sized parallelepipedal elongate magnets 13 which extend parallel to one another. They have a spacing which is somewhat larger than the diameter of the residual mandrel 18. At the rear end of the receiving chamber, corresponding to the rear end of the two magnets, there is formed the stop 15 which thus defines the position of the residual mandrel 18 in the receiving chamber.

The invention claimed is:

1. A rivet setting device, with a housing (1), a holder (2) located in the housing and configured to hold a rivet (17), a pulling device (5) located in the housing (1) for pulling engagement on a rivet mandrel (16) of the rivet (17) that is located in the holder (2), a drive connected to the pulling device (5), a receiving chamber for at least one broken-off residual mandrel (18), which receiving chamber is formed in the housing 1) behind the holder (2) for the rivet (17) in an extension of the holder (2), and with at least one magnet (13) in the receiving chamber for the residual mandrel (18).

2. The rivet setting device as claimed in claim 1, wherein at least one magnet (13) is arranged offset laterally with respect to an extension of a channel (3) for the rivet mandrel (16), which channel is formed in the holder (2).

3. The rivet setting device as claimed in claim 2, further including two elongate magnets (13) which extend parallel to one another, are arranged on first and second sides of the extension of the channel (3), and form space for the residual mandrel (18) between them.

4. The rivet setting device as claimed in claim 1, comprising a stop (15) for the residual mandrel (18), which stop is in the extension of the holder (2) and delimits the receiving chamber.

5. The rivet setting device as claimed in claim 1, wherein the magnet (13) is in the receiving chamber which is moveable transversely with respect to an axis of the holder (2) for the rivet mandrel (16).

6. The rivet setting device as claimed in claim 5, further including a drive for setting the rivet (17) wherein the receiving chamber is movable between a receiving position, in which the at least one magnet (13) is arranged in a receiving position, and a release position, in which the drive for setting the rivet (17) can be engaged with the rivet (17) in the holder (2).

7. The rivet setting device as claimed in claim 6, further including at least one stripping element (24) which is positioned in a path of the residual mandrel (18) held by the magnet (13) when said mandrel is moved between the receiving position and the release position.

8. The rivet setting device as claimed in claim 5, further including a positive guide for moving the receiving chamber when actuating the pulling device of the rivet setting device.

9. The rivet setting device as claimed in claim 1, further including a collecting chamber in the housing for collecting a plurality of broken-off residual mandrels (18).

* * * * *